US008172474B2

(12) United States Patent
Dickover et al.

(10) Patent No.: US 8,172,474 B2
(45) Date of Patent: May 8, 2012

(54) PEN TETHER COMPRESSIVE DISCONNECT

(75) Inventors: Wesley Dale Dickover, Stuart, FL (US); Dean Frederick Herring, Youngsville, NC (US); Philip M. Woodward, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 1194 days.

(21) Appl. No.: 11/947,937

(22) Filed: Nov. 30, 2007

(65) Prior Publication Data

US 2009/0142126 A1 Jun. 4, 2009

(51) Int. Cl.
*B43K 23/02* (2006.01)

(52) U.S. Cl. ..... 401/131; 401/195; 24/3.13

(58) Field of Classification Search ..... 401/48, 401/52, 88, 131, 195; 24/3.1, 3.13
See application file for complete search history.

(56) References Cited

U.S. PATENT DOCUMENTS 1,506,207 A * 8/1924 Wahl ..... 24/10 R
5,123,548 A * 6/1992 Milne ..... 211/69.5
6,167,596 B1 1/2001 Berman
6,394,677 B2 * 5/2002 Wang ..... 401/6
6,435,749 B1 8/2002 Lecce
6,854,681 B2 * 2/2005 Kish ..... 242/380
2007/0020033 A1 1/2007 Walsh
2007/0110498 A1 5/2007 Walsh

OTHER PUBLICATIONS

U.S. Appl. No. 11/939,724, filed Nov. 14, 2007, Herring.
U.S. Appl. No. 11/939,929, filed Nov. 14, 2007, Herring.

* cited by examiner

*Primary Examiner* — David Walczak
(74) *Attorney, Agent, or Firm* — Yee & Associates, P.C.; Tom Tyson

(57) ABSTRACT

A writing instrument is releasably attached to a tether. The writing instrument has a hollow body. A locking cap assembly is configured to be coupled to a tether. The locking cap assembly is further configured to detach from the hollow body of the writing instrument when a force is applied to the tether. The locking cap assembly is inserted into an end of the hollow body of the writing instrument. The locking cap assembly comprises a compressive locking cap. The compressive locking cap comprises a compression fastener, a cap, and a nut. The compression fastener and cap have a hole and one end of the tether passes completely through the compressive locking cap through the hole. The nut is coupled to the end of the tether that passed completely through the compressive locking cap.

13 Claims, 2 Drawing Sheets

PEN TETHER COMPRESSIVE DISCONNECT

BACKGROUND OF THE INVENTION

1. Field of the Invention

The present invention relates generally to a writing instrument. More specifically the present invention relates to a writing instrument that detaches from a tether.

2. Description of the Related Art

Many places have pens that are used for writing or for signing electronically. Places such as banks, post offices, retail establishments, and other public locations provide pens for use by the customers. These pens are typically secured by a tether. Pens need to be replaced either because the pen has run out of ink, because it has been stolen, because the tether has been stripped, or because a new model needs to be added. A pen replacement procedure for a secured pen usually involves a maintenance person.

Replacement of the pen requires that a tool be used. For example, shears appropriate to cut the tether may have to be employed. This means calling in maintenance personnel. As a practical matter, in large institutional use, it is important that the secured pen be removable from the base and replaceable without requiring a tool. This permits any person to make the change. It tends to assure that when the pen has to be replaced, it will be replaced because there is no need either to find the tool or to find the person who is authorized to use the tool. By assuring the ready replacement of pens, a substantial problem of customer complaint concerning inoperative pens is avoided.

Accordingly, the primary object of exemplary embodiments is to provide a pen and a penholder, which permit quick and easy replacement of the pen in the penholder without requiring the use of a tool either to remove the pen from the penholder or to attach the pen to the penholder.

BRIEF SUMMARY OF THE INVENTION

Exemplary embodiments provide for a method, system and apparatus for releasably attaching a writing instrument to a tether. The writing instrument has a hollow body and a locking cap assembly for coupling to a tether. The locking cap assembly is configured to detach from the hollow body when a force is applied to the tether. The locking cap assembly is inserted into an end of the hollow body. The locking cap assembly comprises a compressive locking cap and a nut. The compressive locking cap comprises a compression fastener and a cap. The compression fastener and cap have a hole and one end of the tether passes completely through the compressive locking cap through the hole. The nut is coupled to the end of the tether that passed completely through the compressive locking cap.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Exemplary embodiments secure a tether to a hollow pen body by means of a compressive locking cap and tether keeper nut. The compressive locking cap is inserted into pen body with compressive elements that form fit to the inside of the pen body. These compressive elements keep the compressive locking cap in place until a pull out force is encountered that is greater than the normal forces on the cap. Greater forces than normal are often the result of abuse and the pen is meant to separate from the tether so that no harm comes to the tether. The other advantage is that the pen, if broken, can be replaced rather easily by applying this pull out force to the tether on purpose. A service call is saved with this method as the pen can be replaced by the customer. The compressive locking cap end is removed by pulling on the tether, which in turn is connected to a nut that has been secured to the end of the tether further in than the cap itself. Pulling on the tether puts a force on the end of the compressive locking cap within the pen and forces the compressive locking cap out of the pen. Insertion of the compressive locking cap is by insertion of the nut on the tether first and then the compressive locking cap. The compressive locking cap is captured on the tether via a hole in the compressive locking cap that the tether passes through.

Exemplary embodiments provide a compressive locking cap that can be used over again with the advent of new pens. Having the compressive locking cap separate from the pen based on force applied on the tether prevents the tether from being broken or stripped out.

Figure 1:
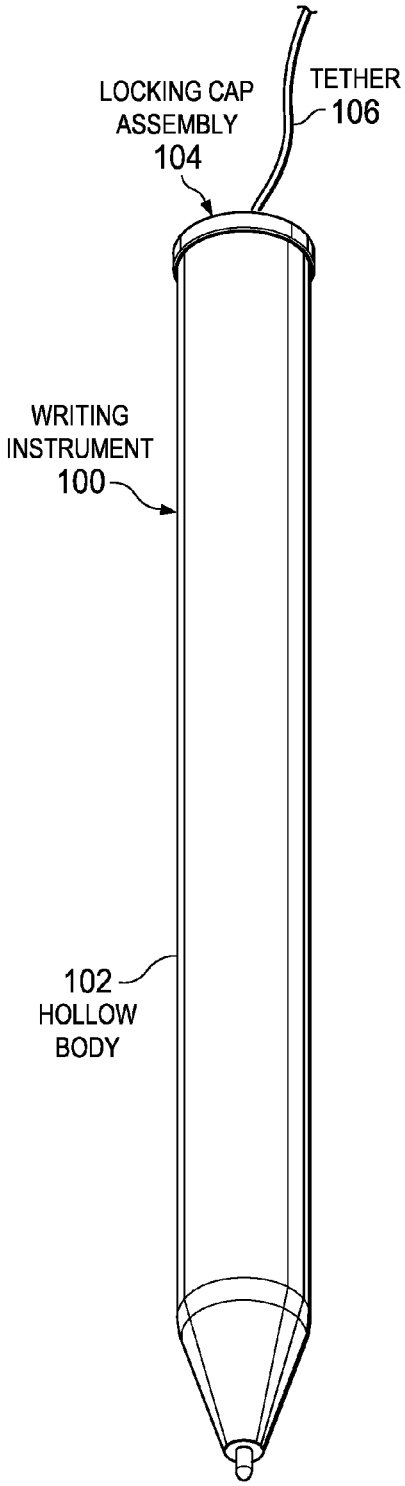
FIG. 1 depicts a pen coupled to a tether according to an exemplary embodiment of the present invention.
Figure 2:
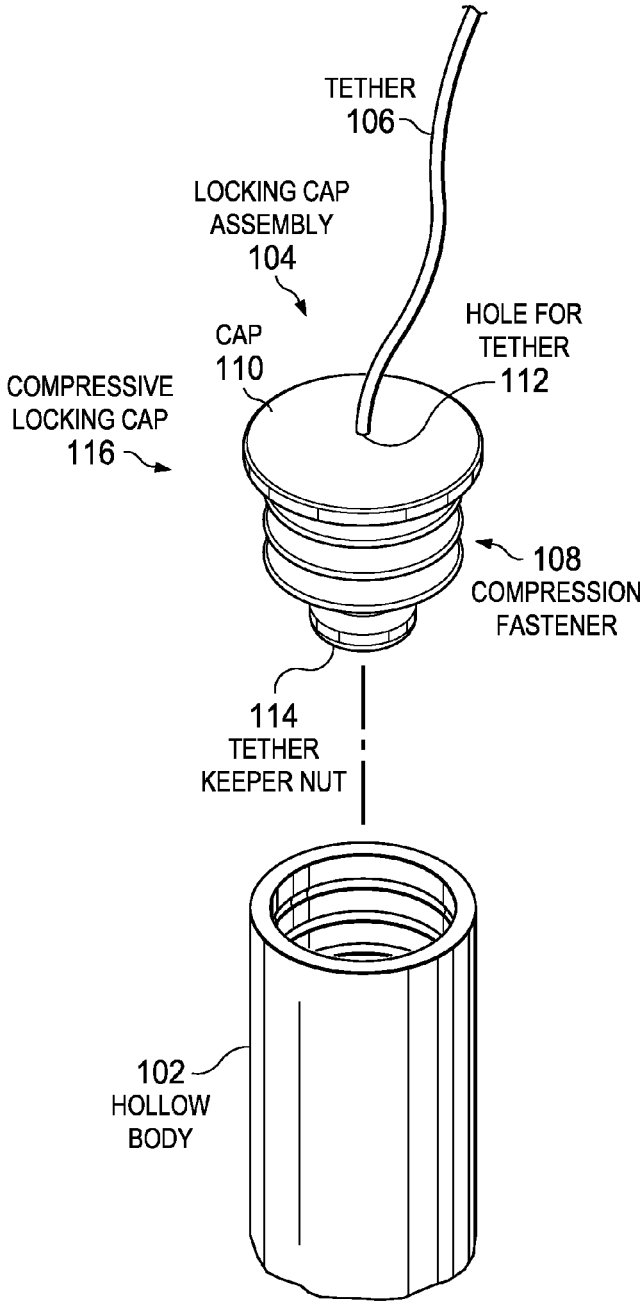
FIG. 2 depicts an exploded view of a pen and locking cap assembly according to an exemplary embodiment of the present invention.

FIGS. 1 and 2 represent the same exemplary embodiment. FIG. 1 depicts a writing instrument coupled to a tether according to an exemplary embodiment of the present invention. Writing instrument 100 comprises hollow body 102. Hollow body 102 is connected to tether 106 via locking cap assembly 104.

Tether 106 may comprise a molded security cable, metal wire, metal chain, plastic wire, string, fiber cable, or any type of appropriate material depending on the specific implementation. Writing instrument 100 may be any type of writing instrument, such as an ink pen or a pen used to generate electronic signatures.

FIG. 2 depicts an exploded view of a pen and locking cap assembly according to an exemplary embodiment of the present invention. Locking cap assembly 104 is shown as being separated from, or pulled out of, hollow body 102. Locking cap assembly 104 comprises tether keeper nut 114 and compressive locking cap 116. Compressive locking cap 116 comprises compression fastener 108 and cap 110. A hole 112 passes through the center of compression fastener 108 and cap 110 through which tether 106 may be inserted. The end of tether 106 is coupled to tether keeper nut 114. Compressive locking cap 116 can move freely, or slide, along tether 106. In the present example, compression fastener 108 is a Christmas tree type fastener. However, in other exemplary embodiments, any type of compression fastener may be used as part of locking cap assembly 104.

Figure 3:
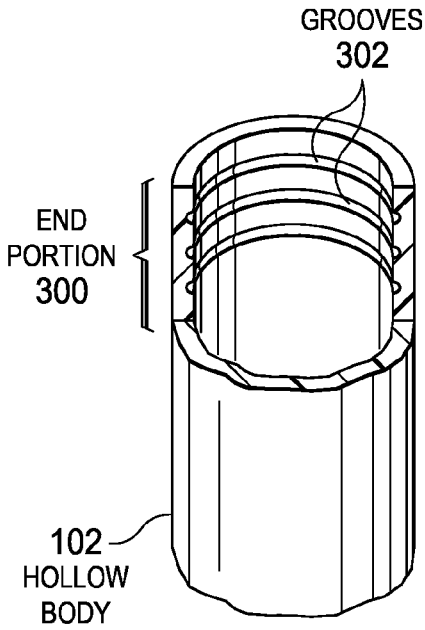
FIG. 3 is a cut away view of the interior of an end portion of a hollow body of a writing instrument in accordance with an exemplary embodiment.

FIG. 3 is a cut away view of the interior of an end portion of a hollow body of a writing instrument in accordance with an exemplary embodiment. The interior of end portion 300 of hollow body 102 is configured to have grooves 302. Grooves 302 increases the force required to be applied to a tether to remove compressive locking cap from writing instrument 100 of FIG. 1. In alternate exemplary embodiments the interior of end portion 300 of hollow body 102 has some type of uneven surface other than grooves 302, such as, for example, but not limited to, ridges, mottling, stippling, or some type of raised pattern, either regular or irregular in shape, in order to increase the force required to remove compressive locking cap from writing instrument 100 of FIG. 1.

Figure 4:
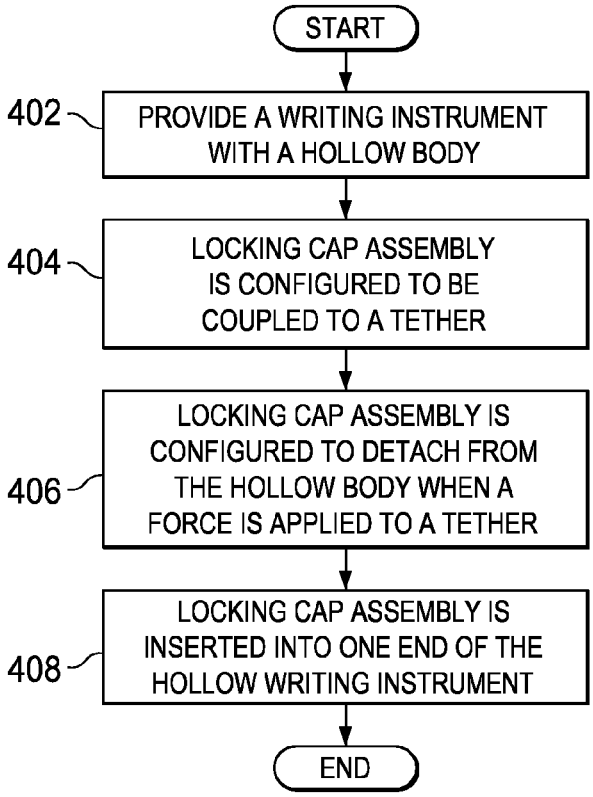
FIG. 4 is flowchart illustrating the operation of releasably attaching a writing instrument to a tether in accordance with an exemplary embodiment.

FIG. 4 is flowchart illustrating the operation of releasably attaching a writing instrument to a tether in accordance with an exemplary embodiment. The operation begins by providing a writing instrument with a hollow body (step 402). A locking cap assembly is configured to be coupled to a tether (step 404). The locking cap assembly is configured to detach from the hollow body when a force is applied to a tether (step 406). The locking cap assembly is inserted into one end of the hollow writing instrument (step 408) and the operation ends. A compressive locking cap comprises a compression fastener and a cap. The compressive locking cap has a hole passing through the center of the compression fastener and cap. One end of the tether passes through the compressive locking cap through the hole. The end of the tether that passed through the compressive locking cap is coupled to a nut. As used in FIGS. 1 through 4, the term "writing instrument" is a generic term and refers generally to any type of writing instrument, such as, for example, but not limited to, an ink pen, a ball point pen, a felt tip pen, a calligraphy pen, or a writing instrument, such as a pen or stylus, used to generate an electronic signature.

Thus, exemplary embodiments provide a compressive locking cap that is inserted into the end of a writing instrument that can be used repeatedly and is removed by application of an external force to the writing instrument. The compressive locking cap is inserted into a pen body with compressive elements that form fit to the inside of the pen body. These compressive elements keep the compressive locking cap in place until a pull out force is encountered that is greater than the normal forces on the cap. Greater forces than normal are often the result of abuse and the pen is meant to separate from the tether so that no harm comes to the tether. The other advantage is that the pen, if broken, can be replaced rather easily by applying this pull out load to the tether on purpose. A service call is saved with this method as the pen can be replaced by the customer.

The exemplary embodiment described above has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A writing instrument comprising:

a hollow body; and a locking cap assembly operably coupling the writing instrument to a tether, inserted into an end of the hollow body, and configured to detach from the hollow body when a force is applied to the tether, the locking cap assembly comprising:

a compressive locking cap, wherein the compressive locking cap comprises a compression fastener and a cap, wherein the compression fastener and the cap have a hole wherein one end of the tether passes through the hole and through an interior of the compressive locking cap; and a nut coupled to the one end of the tether that passes through the hole and through the interior of the compressive locking cap.

2. The writing instrument of claim 1, wherein the compression fastener is a Christmas tree type fastener that engages the hollow body so that the locking cap assembly separates from the hollow body before any harm is caused to the tether.

3. The writing instrument of claim 1, wherein the tether is a molded security cable.

4. The writing instrument of claim 1, wherein an interior portion of the hollow body has grooves, wherein the grooves increase the force required to cause the locking cap assembly to detach from the hollow body.

5. A system for detaching a writing instrument from a tether, the system comprising:

a tether;

a writing instrument having a hollow body, and a locking cap assembly for coupling the writing instrument to the tether, inserted into an end of the hollow body of the writing instrument, and configured to detach from the hollow body of the writing instrument when a force is applied to the tether, the locking cap assembly comprising:

a compressive locking cap, wherein the compressive locking cap comprises a compression fastener and a cap, wherein the compression fastener and the cap have a hole, and wherein one end of the tether passes through the hole and through an interior of the compressive locking cap; and a nut coupled to the one end of the tether that passes through the hole and through the interior of the compressive locking cap.

6. The system of claim 5, wherein the compression fastener is a Christmas tree type fastener that engages the hollow body so that the locking cap assembly separates from the hollow body before any harm is caused to the tether.

7. The system of claim 5, wherein the tether is a molded security cable.

8. The system of claim 5, wherein an interior portion of the hollow body has grooves, wherein the grooves increase the force required to cause the locking cap assembly to detach from the hollow body.

9. A method for releasably attaching a writing instrument to a tether, the method comprising:

providing a writing instrument having a hollow body;

configuring a locking cap assembly to be coupled to a tether and to detach from the hollow body of the writing instrument when a force is applied to the tether, wherein the locking cap assembly comprises a compressive locking cap having a compression fastener and a cap, the compression fastener and the cap having a hole, wherein one end of the tether passes through the through the hole and through an interior of the compressive locking cap, and wherein a nut is coupled to the one end of the tether that passes through the hole and through the interior of the compressive locking cap; and inserting the locking cap assembly into one end of the hollow body of the writing instrument.

10. The method of claim 9, wherein the compression fastener is a Christmas tree type fastener that engages the hollow body so that the locking cap assembly separates from the hollow body before any harm is caused to the tether.

11. The method of claim 9, wherein the tether is a molded security cable.

12. The method of claim 9, wherein an interior portion of the hollow body has grooves, wherein the grooves increase the force required to cause the locking cap assembly to detach from the hollow body.

13. The writing instrument of claim 1 wherein the hollow body has an interior end portion comprising one or more profiles that increase a pull out load required to remove the compressive locking cap from the hollow body; and wherein the one or more profiles are selected from a group consisting of an uneven surface, ridges, mottling, stippling, a raised pattern, and an irregular shape.

* * * * *